US006379499B1

(12) United States Patent
Yang et al.

(10) Patent No.: US 6,379,499 B1
(45) Date of Patent: Apr. 30, 2002

(54) POLYMER-ALDEHYDE ADDITIVES TO IMPROVE PAPER PROPERTIES

(75) Inventors: Charles Q. Yang; Guozhong Xu, both of Athens, GA (US)

(73) Assignee: University of Georgia Research Foundation, Inc., Athens, GA (US)

( * ) Notice: Subject to any disclaimer, the term of this patent is extended or adjusted under 35 U.S.C. 154(b) by 0 days.

(21) Appl. No.: 09/672,655

(22) Filed: Sep. 28, 2000

Related U.S. Application Data

(60) Provisional application No. 60/156,422, filed on Sep. 28, 1999.

(51) Int. Cl.[7] ..... D21H 17/06; D21H 17/36

(52) U.S. Cl. ..... 162/168.1; 162/173; 162/181.2

(58) Field of Search ..... 162/127, 128, 162/135, 136, 137, 157.1, 157.2, 164.1, 157.4, 157.5, 168.1, 170, 173, 175, 176, 177, 178, 180, 181.1, 181.2, 181.3, 158, 112, 165, 166, 169, 111

(56) References Cited

U.S. PATENT DOCUMENTS

| | | | | | |
|---|---|---|---|---|---|
| 2,402,469 | A | | 6/1946 | Toland et al. | 92/21 |
| 3,597,313 | A | | 8/1971 | Williams et al. | 162/167 |
| 4,210,489 | A | | 7/1980 | Markofsky | 162/164 R |
| 4,262,067 | A | * | 4/1981 | Philipp et al. | 429/139 |
| 4,272,470 | A | | 6/1981 | Hsu et al. | 264/104 |
| 4,357,402 | A | * | 11/1982 | Sheibley et al. | 429/206 |
| 4,376,183 | A | | 3/1983 | Haskell | 524/417 |
| 4,469,735 | A | | 9/1984 | Trokham | 428/154 |
| 4,472,552 | A | | 9/1984 | Blouin | 525/61 |
| 4,537,807 | A | * | 8/1985 | Chan et al. | 428/74 |
| 4,605,718 | A | | 8/1986 | Jansma et al. | 526/240 |
| 4,665,987 | A | | 5/1987 | Sandiford et al. | 166/288 |
| 4,708,947 | A | * | 11/1987 | Maruyama et al. | 503/209 |
| 4,820,307 | A | | 4/1989 | Welch et al. | 8/120 |
| 4,832,791 | A | * | 5/1989 | Detert et al. | 162/99 |
| 4,871,424 | A | | 10/1989 | Dreisbach et al. | 162/168.1 |
| 4,886,575 | A | | 12/1989 | Moreland | 162/5 |
| 4,888,093 | A | | 12/1989 | Dean et al. | 162/157.6 |
| 4,935,463 | A | | 6/1990 | Stockel et al. | 524/423 |
| 4,936,865 | A | | 6/1990 | Welch et al. | 8/120 |
| 4,975,209 | A | | 12/1990 | Welch et al. | 25/8.6 |
| 5,057,570 | A | | 10/1991 | Miller et al. | 524/503 |
| 5,147,908 | A | | 9/1992 | Floyd et al. | 524/49 |
| 5,212,008 | A | | 5/1993 | Malhotra et al. | 428/216 |
| 5,221,285 | A | | 6/1993 | Andrews et al. | 8/127.1 |
| 5,281,307 | A | | 1/1994 | Smigo et al. | 162/164.3 |
| 5,328,567 | A | | 7/1994 | Kinsley, Jr. | 162/158 |
| 5,380,403 | A | | 1/1995 | Robeson et al. | 162/147 |
| 5,397,436 | A | | 3/1995 | Robeson et al. | 162/158 |
| 5,427,587 | A | | 6/1995 | Arkens et al. | 8/116.1 |
| 5,484,509 | A | | 1/1996 | Famili et al. | 162/135 |
| 5,496,649 | A | * | 3/1996 | Mallory et al. | 428/518 |
| 5,567,798 | A | | 10/1996 | Dulany et al. | 528/332 |
| 5,585,456 | A | | 12/1996 | Dulany et al. | 528/332 |
| 5,594,050 | A | | 1/1997 | Audebert et al. | 524/5 |
| 5,690,790 | A | * | 11/1997 | Headlam et al. | 162/175 |
| 5,840,423 | A | | 11/1998 | Sano et al. | 438/364 |
| 5,916,418 | A | * | 6/1999 | Frank et al. | 162/135 |
| 6,054,519 | A | * | 4/2000 | Jakob et al. | 524/354 |

FOREIGN PATENT DOCUMENTS

| | | | | |
|---|---|---|---|---|
| DE | 4323560 | | 1/1994 | D21H/21/20 |
| EP | 440472 B1 | | 8/1995 | D21H/11/20 |
| EP | 778290 | | 11/1996 | C08F/4/40 |
| EP | 934738 | | 8/1999 | A61F/13/15 |
| GB | 2017124 | * | 10/1979 | C08G/4/00 |
| WO | WO 95/26441 | | 11/1995 | D21H/27/38 |

OTHER PUBLICATIONS

"Airvol Polyvinyl Alcohol—Applications" [on–line] *Air Products and Chemicals, Inc.,* [retrieved on Nov. 17, 1998]. Retrieved from the Internet: <URL:http://www.airproducts.com/chemicals/airvol–paper/main.html>.

"Airvol Polyvinyl Alcohol Business Overview" [on–line] *Air Products and Chemicals, Inc.,* 1998 [retrieved on Feb. 9, 2001]. Retrieved from the Internet:<URL:http://www.airproducts.com/chemicals/airvpoly.html>.

"Folding Endurance of Paper (MIT Tester)" *TAPPI Standard Testing Method T 511 om–96.* (1996).

"Testing Breaking Properties of Paper and Paperboard (Using Constant Rate of Elongation Apparatus)" *TAPPI Standard Testing Method T 494 om–88.*

Caulifield, D. F. (Mar. 1994) "Ester Crosslinking to Improve Wet Performance of Paper Using Multifunctional Carboxylic Acids, Butanetetracarboxylic Acid and Citric Acid" *Tappi J.* 77(3):205–212.

Chan, L. L., (1994) "Wet–Strength Resins and Their Application" *Tappi Press* 45–62.

Eldred, N.R. and Spicer, J.C. (Oct. 1963) "Glyoxal: A Unique Wet–Strength Agent" *Tappi* 46(10):608–612.

Finch, C.A., Ed (1973) "Polyvinyl Alcohol: Properties and Applications" John Wiley & Sons 290–293.

Frick, J. G. and Harper, R. J. (1982) "Crosslinking Cotton Cellulose with Aldehydes" *J. Appl. Polym. Sci.* 27:983–988.

Frick, J. G. and Harper, R. J. (1984) "Acetals as Crosslinking Reagents for Cotton" *J. Appl. Polym. Sci.* 29:1433–1447.

Horie D. and Biermann, C. J. (Aug. 1994) "Application of Durable–Press Treatment to Bleached Softwood Kraft Handsheets" *Tappi J.* 77(8):135–140.

(List continued on next page.)

*Primary Examiner*—Peter Chin
*Assistant Examiner*—Eric J. Hug
(74) *Attorney, Agent, or Firm*—Greenlee, Winner & Sullivan, P.C.

(57) ABSTRACT

The strength properties of paper are improved by treating the paper with a hydroxy-containing polymer, a multifunctional aldehyde and a catalyst. The multifunctional aldehyde is present at a concentration of about 50% to about 800% weight percent of the polymer, the catalyst is present at a weight ratio of between about 1:0.1 to about 1:2 multifunctional aldehyde:catalyst and the total weight of the polymer, aldehyde and catalyst is between about 0.1% to about 10% based on the dry weight of the paper.

20 Claims, No Drawings

OTHER PUBLICATIONS

Linke, W. F. (Nov. 1968) "Retention and Bonding of Synthetic Dry Strength Resins" *Tappi J.* 51(11):59A–65A.

Pereira et al., (Jun. 1998) "The Use of a Mild Biocide to Reduce Biofouling in Paper and Pulp Production Processes" Proc. On 7$^{th}$ International Conference on Biotech in Pulp and Paper Industry C193–196.

Welch, C. M. (1992) "Formaldehyde–free Durable–press Finishes" *Review of Progress in Coloration* 22:32–41.

Welch, C. M. and Danna, G. F. (Feb. 1982) "Glyoxal as a Non–Nitrogenous Formaldehyde–Free Durable–Press Regent for Cotton" *Textile Res. J.* 2:149–157.

Xu, Y. et al., (Aug. 1999) "Wet Reinforcement of Paper with High–Molecular–Weight Multifunctional Carboxylic Acid" *Tappi J.* 150–156.

Xu. Y. et al. (Nov. 1998) "Application of Polymeric Multifunctional Carboxylic Acids to improve Wet Strength" *Tappi J.* 81(11):157–164.

Yang C.Q. and Xu, Y. (1998) "Paper Wet Performance and Ester Crosslinking of Wood Pulp Cellulose by Poly(carboxylic Acid)s" *Journal Applied Polymer Science* 67:649–658.

Yang, C. Q. and Wang, X. (1997) "Infrared Spectroscopy Studies of the Cyclic Anhydride as the Intermediate for the Ester Crosslinking of Cotton Cellulose by Polycarboxylic Acids. III. Molecular Weight of a Crosslinking Agent" *Journal of Polymer Science: Part A: Polymer Chemistry* 35:557–564.

Yang, C. Q. and Wang, X. (1996) "Infrared Spectroscopy Studies of the Cyclic Anhydride as the Intermediate for the Ester Crosslinking of Cotton Cellulose by Polycarboxylic Acids. II. Comparison of Different Polycarboxylic Acids" *Journal of Polymer Science: Part A: Polymer Chemistry* 34:1573–1580.

Yang, C. Q. et al. (1996) "FT–IR Spectroscopy study of the Polycarboxylic Acids Used for Paper Wet Strength Improvement" *Ind. Eng. Chem. Res.* 35:4037–4042.

Zhou, Y. J. et al. (1993) "Wet Reinforcing of Paper and Board by Novel Crosslinking Chemicals" *Products of Papermaking* 2:1045–1072.

Zhou, Y. J. et al. (1995) "Mechanism of Crosslinking of Papers with Polyfunctional Carboxylic Acids" *Journal Applied Polymer Science* 58:1523–1534.

* cited by examiner

POLYMER-ALDEHYDE ADDITIVES TO IMPROVE PAPER PROPERTIES

CROSS REFERENCE TO RELATED APPLICATIONS

This application takes priority to U.S. Provisional Patent Application Ser. No. 60/156,422, filed Sep. 28, 1999, the disclosure of which is hereby incorporated by reference to the extent not inconsistent with the disclosure herein.

BACKGROUND OF THE INVENTION

The paper industry uses additives to improve the properties of paper. Additives may be added to paper pulp slurry prior to sheet formation (wet-end addition), or applied to paper after sheet formation (dry-end addition). Some properties that are desired in paper depending on its application include wet strength, dry strength, folding endurance, oil resistance and solvent/stain resistance.

For ease of processing and commercial applicability, the curing temperature of the paper should be as low as possible, the time of treatment should be short, and the cost of the additives used should be low. Also, the treatments should not emit environmentally harmful products. Additives currently used to improve wet strength, such as urea-formaldehyde (UF), melamine-formaldehyde (MF), and polyamide/polyamide-epichlorohydrin (PAE) are believed to emit formaldehyde (UF and MF) or absorbable organic halogens (AOX).

In an attempt to produce paper with desired properties, as well as decrease the amount of environmentally harmful chemicals being produced from paper production, various additives have been studied.

The dry properties of the paper are affected by the nature of crosslinks produced in the paper network. Small molecules such as glutaraldehyde are able to penetrate readily into cellulosic fibers and produce crosslinks between cellulosic molecules inside the fiber (Linke, W. F., (1968) *Tappi J.* 51(11):59A–65A). These crosslinks are located predominantly in the amorphous regions of the fiber wall and restrict the mobility of microstructural units of fibers. The intrafiber crosslinks produced by the small molecules such as glutaraldehyde alone do not contribute to fiber bonding and thus have little effect on the dry strength of paper. However, the intrafiber crosslinks increase the rigidity of fibers, and thus impart a more heterogeneous distribution of stress in the paper network. The result of intrafiber crosslinks is the reduction in the stretch of treated paper. The decrease in the stretching ability of paper also leads to premature breakage of paper, thus leading to an overall reduction in dry strength. Paper treated with high levels of glutaraldehyde exhibits loss of dry strength and decreased folding endurance.

Certain dialdehydes have been studied as crosslinking agents of cellulose to impart wrinkle resistance to cotton fabric (Frick, J. G., et al., (1982) *J. Appl. Polym. Sci.* 27:983–988; Frick, J. G., et al. (1984) *J. Appl. Polym. Sci.* 29:1433–1447). The reaction between certain dialdehydes and cellulose is promoted by using metallic salts and ammonium salts as catalysts (Petersen, H. A. (1983) in *Chemical Processing of Fibers and Fabrics: Functional Finishes Part A*", Chapter 2, Lewin, M et al. (eds.), New York, pp. 47–327). The most frequently used metallic catalysts include inorganic salts of aluminum, magnesium and zinc.

Glyoxal has been used to provide temporary wet strength for paper (Eldred, N. R. et al. (1963) *Tappi* 46(10):608–612). Glyoxal crosslinks cellulose molecules by formation of hemiacetal links, which are sensitive to water. If an acid catalyst is used, more stable acetal linkages are reported to be formed. However, the use of glyoxal, especially in an acidic treatment process, leads to serious embrittlement of paper, similar to the use of small polycarboxylic acids.

U.S. Pat. No. 4,547,807 (Chan et al.) relates to a method of temporarily improving the wet strength of pre-moistened towelette paper by reacting the paper with an adhesive formed from the reaction of a polyvinyl alcohol with glyoxal or related dialdehydes. Papers produced by the disclosed process reportedly exhibit enhanced wet strength when stored in an acidic medium and decreased wet strength when immersed in a basic medium. No catalyst is used.

U.S. Pat. No. 4,888,093 (Dean et al.) reports the use of certain dialdehydes to reportedly provide individualized, crosslinked cellulosic fibers.

Fully hydrolyzed polyvinyl alcohol (PVA) is a polymer with high tensile strength, excellent flexibility, good water resistance, and outstanding binding capacity (Finch, C. A. Ed., "Polyvinyl Alcohol: Properties and Applications," John Wiley & Sons, (1973), pp.277–230). Polyvinyl alcohol (PVA) has been used in the paper processing industry for surface and internal sizing of paper and to impart water resistance to paper.

Large amounts of PVA (approximately 10% on an oven-dried basis of the pulp) have been added to pulp in wet-end processing to reportedly enhance paper wet strength (U.S. Pat. No. 2,402,469 (Toland et al.), discussed in U.S. Pat. No. 5,328,567 (Kinsley)). The PVA product described is water soluble at 130° F. PVA has been reported to control pitch deposition on processing equipment used when paper is formed (U.S. Pat. No. 4,871,424 (Dreisbach et al.)). PVA has also been reported to control "stickies" that may form during paper processing from the adhesives, ink and coating binders remaining from papers used in the recycled paper industry (U.S. Pat. No. 4,886,575 (Moreland)).

U.S. Pat. No. 5,281,307 (Smigo et al.) discloses the use of polyvinyl alcohol/vinylamine copolymers with a crosslinking agent to treat paper in a dry-end process. No catalysts are used. The process disclosed required a heat treatment of 150° C. for 5 minutes after the paper was formed.

U.S. Pat. No. 5,380,403 (Robeson et al.) discloses the use of an amine functionalized polyvinyl alcohol in combination with a cyclic ester or anhydride in a wet-end process to reportedly improve the wet strength of recycled paper.

Even though many additives have been studied in an attempt to improve the properties of paper, there is a continuing need for an environmentally-friendly treatment that imparts permanent improvement in wet strength, dry strength and folding endurance to the paper.

All references cited herein are hereby incorporated by reference to the extent not inconsistent with the disclosure herein.

SUMMARY OF THE INVENTION

A method of treating paper with a hydroxy-containing polymer and a multifunctional aldehyde in the presence of a catalyst to improve the strength properties of paper including wet strength, dry strength and folding endurance is provided. As used herein, "paper" includes paper sheets after formation, or paper pulp before sheet formation, among other forms as known in the art. In the method of the invention, the aldehyde is present in amounts of between about 50% to 800% weight percent of the polymer present, and all intermediate ranges therein. Preferably, the aldehyde is used in an amount of greater than 100% the weight percent of polymer. The catalyst is preferably present at a percentage weight ratio between about 1:0.1 to about 1:2 aldehyde:catalyst and all intermediate ranges therein, and more preferably present at a weight ratio of 1:0.2 to 1:1 aldehyde:catalyst. The treatment chemicals are typically used in total amounts of between about 0.1% to about 10% based on dry weight of pulp fibers, and all intermediate ranges therein. The presently preferred treatment uses between about 0.25% to about 4% by weight of treatment chemicals, based on dry weight of pulp fibers.

Also provided is a method of treating paper comprising: contacting said paper with a non amine-functionalized hydroxy-containing polymer and a multifunctional aldehyde, wherein the multifunctional aldehyde has formula:

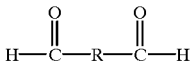

where R is a divalent aliphatic, cycloaliphatic, aromatic or heterocyclic group having from 1 to 12 carbon atoms; the multifunctional aldehyde is present at a concentration of about 50% to about 800% weight percent of the polymer present; and the total weight of hydroxy-containing polymer and multifunctional aldehyde is about 0.1% to about 10% based on the dry weight of pulp fibers. The hydroxy-containing polymer and multifunctional aldehyde composition may further comprise a catalyst selected from the group consisting of $AlCl_3$, $Al_2(SO_4)_3$, $Al(NO_3)_3$, alum, $ZnCl_2$, $Zn(NO_3)_2$, $Zn(CH_3COO)_2$, $MgCl_2$, $Mg(NO_3)_2$, $Mg(CH_3COO)_2$, $NH_4Cl$ and amino acids; wherein said catalyst is present at a weight ratio between about 1:0.1 to about 1:2 multifunctional aldehyde:catalyst; and the total weight of hydroxy-containing polymer, multifunctional aldehyde and catalyst is about 0.1% to about 10% based on the dry weight of pulp fibers.

Contacting means providing an appropriate vessel or apparatus so that the treatment chemicals are in contact with the paper. Method of contacting are known in the art.

Preferably, the multifunctional aldehyde is gluteraldehyde and said hydroxy-containing polymer is non-amine functionalized poly vinyl alcohol. Preferably, the multifunctional aldehyde:polymer weight ratio is greater than 1:1. Preferably the catalyst is present at a weight ratio from about 1:0.2 to about 1:1 multifunctional aldehyde:catalyst. It is preferred that the total weight of hydroxy-containing polymer, multifunctional aldehyde and catalyst is between about 0.25% to about 4% by weight of the dry weight of paper treated.

The method may further comprise curing the paper at a sufficient conditions to cause the desired improvement in strength properties of said paper. These conditions are well known in the art without undue experimentation using the knowledge in the art and the teachings described herein. One example of such conditions is a temperature which is between about 100 to about 150° C. for a time of between about 0.5 and about 5 minutes. Other temperatures and times may be used, for example all intermediate temperature ranges and times therein.

Also described is paper treated with the methods described herein.

Also provided is a paper treatment composition comprising: a non amine-functionalized hydroxy-containing polymer and a multifunctional aldehyde wherein the multifunctional aldehyde has formula:

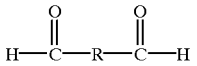

where R is a divalent aliphatic, cycloaliphatic, aromatic or heterocyclic group having from 1 to 12 carbon atoms; the multifunctional aldehyde is present at a concentration of about 50% to about 800% weight percent of the polymer present; and the total weight of hydroxy-containing polymer and multifunctional aldehyde is about 0.1% to about 10% based on the dry weight of pulp fibers.

In this composition, it is preferred that the multifunctional aldehyde is gluteraldehyde and said non amine-functionalized hydroxy-containing polymer is PVA. This composition may further comprise a catalyst selected from the group consisting of: $AlCl_3$, $Al_2(SO_4)_3$, $Al(NO_3)_3$, alum, $ZnCl_2$, $Zn(NO_3)_2$, $Zn(CH_3COO)_2$, $MgCl_2$, $Mg(NO_3)_2$, $Mg(CH_3COO)_2$, $NH_4Cl$ and amino acids, wherein the catalyst is present at a weight ratio between about 1:0.1 to about 1:2 multifunctional aldehyde:catalyst; and the total weight of hydroxy-containing polymer, multifunctional aldehyde and catalyst is about 0.1% to about 10% based on the dry weight of pulp fibers.

Also provided is a method of using the composition described above in a paper making process comprising: contacting said paper with the composition described above for a time sufficient to deposit the desired amount of composition on said paper; curing said paper at a sufficient conditions to cause the desired improvement in strength properties of said paper. These conditions are well known to one of ordinary skill in the art without undue experimentation with the teachings described herein. One example of sufficient conditions to cause the desired improvement in strength properties of said paper is a temperature which is between about 100° C. to about 200° C. for a time which is between about 0.5 to about 5 minutes.

Also provided is an improvement for a papermaking process producing paper having improved strength properties, said improvement comprising: adding a non amine-functionalized hydroxy-containing polymer, a multifunctional aldehyde and a catalyst to paper wherein: the catalyst is selected from the group consisting of: $AlCl_3$, $Al_2(SO_4)_3$, $Al(NO_3)_3$, alum, $ZnCl_2$, $Zn(NO_3)_2$, $Zn(CH_3COO)_2$, $MgCl_2$, $Mg(NO_3)_2$, $Mg(CH_3COO)_2$, $NH_4Cl$ and amino acid; the multifunctional aldehyde has formula:

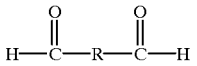

where R is a divalent aliphatic, cycloaliphatic, aromatic or heterocyclic group having from 1 to 12 carbon atoms; the multifunctional aldehyde is present at a concentration of about 50% to about 800% weight percent of the polymer present; the catalyst is present at a weight ratio between about 1:0.1 to about 1:2 multifunctional aldehyde:catalyst; and the total weight of hydroxy-containing polymer, multifunctional aldehyde and catalyst is about 0.1% to about 10% based on the dry weight of pulp fibers.

This process may further comprise curing the paper for a sufficient time and temperature to cause the desired improvement in properties to occur. These conditions are preferably a temperature which is between about 100 to about 500° C. and a time which is between about 0.5 to about 5 minutes.

As used herein, "multifunctional aldehyde" is an aldehyde compound with 2 or more aldehyde functionalities. Multifunctional aldehydes that may be used in the method of this invention include dialdehydes of general formula:

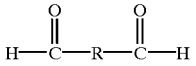

where R is a divalent aliphatic, cycloaliphatic, aromatic, or heterocyclic moiety and mixtures thereof. Preferred dialdehydes include aliphatic dialdehydes where R is a divalent aliphatic hydrocarbon moiety having 1 to 12 carbon atoms, and all intermediate ranges therein, more preferably from 1 to 6 carbon atoms, such as glutaraldehyde, furan dialdehydes, 2-hydroxyadipaldehyde, and succinaldehyde. Polymeric multifunctional aldehydes, such as dialdehyde starch, polyacrolein, poly(meth)acrolein, copolymers of acrolein and methacrolein, and their derivatives may be used in the methods of this invention. Hemiacetal or acetyl compounds that produce aldehyde groups during the application process can also be used. The most preferred multifunctional aldehyde is glutaraldehyde. Mixtures of multifunctional aldehydes may be used in this invention.

Catalysts that promote the reaction between dialdehydes and cellulose and that may also improve the efficiency of the crosslinking system that can be used in the invention include metal salts, such as $AlCl_3$, $Al_2(SO_4)_3$, $Al(NO_3)_3$, alum, $ZnCl_2$, $Zn(NO_3)_2$, $Zn(CH_3COO)_2$, $MgCl_2$, $Mg(NO_3)_2$, $Mg(CH_3COO)_2$. The catalysts also include $NH_4Cl$ and amino acids. The salt catalysts may be used in combination with hydroxyl-containing carboxylic acid, such as citric acid or tartaric acid. Acid catalysts are believed to form more stable acetal linkages. The process may be used along with other additives such as other crosslinkers, defoamers, biocides, plasticizers, among others, either in wet-end or dry-end processing. Other additives that may be used include multifunctional carboxylic acids, specifically poly (maleic acid), which is believed to crosslink cellulose.

"Hydroxy-containing polymers" used in this invention may be derivatized. More preferred hydroxy-containing polymers of this invention include polyvinyl alcohol (PVA) and its derivatives including homo- and copolymers of vinyl alcohol, such as poly(ethylene-vinyl alcohol), completely and partially hydrolyzed PVA. Other PVA derivatives that may be used include cationic PVA copolymers with cationic acrylamide monomers, such as dimethylaminoethyl methacrylate dimethylsulfate quaternary, and cationic PVA formed by reaction of PVA with cationizing agents, such as 2,3-epoxypropyl-N, N, N, -trimethylammonium chloride. PVAs also include various denatured PVA, such as carboxyl or amino denatured PVA. The degree of hydrolysis is not particularly limited, with high and superhydrolyzed PVA preferred. PVA with Brookfield viscosity larger than 5 centipoises and not less than 20 centipoises (when measured at 20° C. with 4% aqueous solutions) is preferred. Preferably the polymer is not amine functionalized.

As used herein, "paper" includes paper products both before sheet formation (paper pulp) and after sheet formation. All grades of paper products, including paperboards, carton and corrugating medium, cellulosic nonwovens, wood fiber-nonwood fiber combinations, and other grades of paper products as known in the art are included within the scope of the term.

Also provided are compositions of polyvinylalcohol, multifunctional aldehyde, preferably gluteraldehyde and catalysts that may be used in the methods of this invention as paper additives to improve the properties of paper. Additionally, paper or paper pulp treated with compositions of polyvinylalcohol, glutaraldehyde and catalysts as described in this invention are provided.

The invention provides advantages over current technology: being environmentally safe without emission of formaldehyde or AOX; improving both wet and dry strength; improving paper wet strength while increasing folding endurance, providing permanent wet strength improvement; using low curing temperatures and shorter curing time compatible with current papermaking machines; reasonable cost; and good repulpability of the resulting paper. The use of a process that imparts both wet and dry strength means that lower grades of pulp fibers and recycled pulp fibers can be utilized to a greater extent.

DESCRIPTION OF THE INVENTION

Applicant does not wish to be bound by any particular theory but, it is believed that when a hydroxy-containing polymer such as PVA is added to a multifunctional aldehyde, the aldehyde will readily react with hydroxyl groups in the polymeric chains through the formation of hemiacetal or acetal links. Thus, the polymer is believed able to chain the aldehyde molecules together. For example, when PVA and glutaraldehyde are used, it is likely that pentanedialated-PVA is formed. Pentanedialated PVA is illustrated in Scheme 1. Scheme 1 shows unreacted hydroxyl groups of PVA, reactive free aldehyde, and hemiacetal groups. If the concentration and ratio between PVA and glutaraldehyde are appropriately controlled, the pentanedialated-PVA is believed to remain sufficiently reactive and stable enough to react with cellulose molecules and produce crosslinks. Because of the bulky size of high molecular weight PVA, it is believed that the pentanedialated-PVA does not penetrate into the fiber interior but stays on the fiber surface, moves to the fiber crossing area, and is driven into pores and cracks in the fiber surface by capillary forces. Long-range crosslinks between fibers are believed to be produced. It is also possible that free glutaraldehyde is produced.

Pentanedialated-PVA may improve the dry performance of paper in two ways. First, the interfiber crosslinks may reinforce the fiber bonding and thus increase the dry strength. Second, since the interfiber area is the center of stress transfer in the network, and the pores and cracks are the weak points of the fiber, presence of polymer may strengthen the weak points of fibers and enhance the stress dissipation of network. The aldehyde may also react with cellulose, producing interfiber and heterogeneous crosslinking. Thus, crosslinking using a polymer/aldehyde system is more effective to improve the wet performance of paper without sacrificing dry properties than a system using an aldehyde alone.

The invention may be more fully understood by reference to the following, nonlimiting examples.

EXPERIMENTAL

1. Materials

The paper used in these experiments was unbleached Kraft paper with grammage of 65 g/m$^2$, manufactured by Southwest Paper, Georgia. Fully hydrolyzed poly(vinyl alcohol) with a viscosity of 62–72 CPS was provided by Air Products, Allentown, Pa. Glutaraldehyde was a 50% aqueous solution provided by Union Carbide, Bound Brook, N.J. Glyoxal was a 40% aqueous solution obtained from B. F. Goodrich Textile Performance Chemicals Division, Charlotte, N.C. Catalyst 531, a combination of magnesium chloride and citric acid with about 40% solid content, is a commercial product obtained from Sequa Chemicals, Inc., Chester, S.C. $MgCl_2$, $AlCl_3$, $NH_4Cl$ and $Zn(NO_3)_2$ were purchased from Aldrich, Milwaukee, Wis. Deionized water was used to prepare all solutions.

2. Dissolution of PVA

PVA was dissolved in water according to the methods described in the book: "Polyvinyl Alcohol: Properties and Applications", C. A. Finch, Ed., John Wiley & Son 1973, pp555–559.

3. Preparation of Treating Solutions

The aqueous solutions of catalyst and PVA were prepared separately. Then the solutions of PVA, aldehyde, and catalyst were mixed together to form a treating solution of desired concentration. The pH was adjusted using conventional acids and alkali. All concentrations were based on weight. The pH of the solution affects the final characteristics of the paper. Typically, pH of between 3.5 to 7.0 were used in these experiments.

The treatment solution can be prepared just before using or prepared previously; the solution may also be pre-reacted by standing or heating at 30 to 90° C. for a specific length of time to produce PVA-aldehyde that is partially crosslinked before using. When the specification refers to contacting chemicals with paper, it is to be understood that compositions that have begun to react are intended to be included.

4. Methods of Applying the Treating Solutions to Paper (dry-end applications)

In the experiments, the kraft paper was cut into 25 cm×25 cm square sheets. The paper sheet was immersed into a treating solution for 30 seconds, and then pressed between two squeezing rollers to remove the excessive solution to reach about 90 to 95% wet pick-up, and finally dried on a hot plate dryer at 85° C. for 3 min. The wet pick-up was determined by weighing the dry and wet paper sheet, Wet Pick-up % =(Wet weight-Dry Weight)/Dry Weight. The dried paper sheet was then cured in an oven at a selected temperature for 1.5 min. The curing temperature of the paper affects the final characteristics of the paper. For these experiments, a range of temperatures between 100–150° C. was used.

The solution can also be applied to paper in any conventional method such as: spraying, immersion, saturation or printing onto the material. Also, the components of the treating solution can be applied to the paper separately.

5. Methods of Applying the Treating Solutions to Paper (wet-end applications)

The invention can also be used to treat paper in a wet-end process. For these experiments, the treating components (hydroxy-containing polymer, multifunctional aldehyde and catalyst) can be used as an aqueous mixture added to the paper pulp during processing, or each component may be added to the paper pulp separately during processing. In addition, some components of the mixture may be added during wet-end processing, and others applied to the paper after paper formation (mixed wet/dry-end processing).

PAPER PERFORMANCE TESTING

1. Sampling

The paper sheets were first conditioned using the TAPPI (Technical Association of the Pulp and Paper Industry) standard condition (23.0° C. and 50.0% relative humidity) for at least 24 hours. From each paper sheet, specimen strips were cut with 16±0.0 mm parallel width and 25 cm length with the longitudinal direction along the paper machine direction. Ten specimens were used for each test. The specimens were reconditioned at the standard conditions for at least 24 hours before testing of dry strength and folding endurance.

2. Dry and Wet Tensile Strength

Tensile strength was measured according to TAPPI Standard Testing Method T 494 om-88 "Tensile breaking properties of paper and paperboard (using constant rate of elongation apparatus)". The tensile tests were performed in an Instron 4411 Tensile Tester. The paper strips were clamped into the instrument's jaws which had a span of 90 mm. The jaws separated at 12.5 mm/min. Ten strips were tested for averaging. For testing of wet tensile strength, the specimens were soaked in tap water for 24 hours before testing. The soaked strips were blotted and immediately clamped into the Instron for testing. For study of the permanence of wet strength of paper, the wet strength was tested after specific lengths of soaking time.

The dry properties of treated paper, i.e., dry strength, and stretch, were expressed as percentage changes over those of a control sample. Traditionally, wet strength is expressed as wet strength retention. However, wet strength retention does not indicate the actual change of wet strength before and after treatment. Therefore, the ratio of the wet strength of treated paper to the dry strength of control sample (W/D) was used as the basis to compare the wet strength of paper treated with various conditions and different compositions of treating solutions.

3. Folding Endurance

Folding endurance was tested according to the TAPPI Standard Testing Method T 511 om-96 "Folding endurance of paper (MIT tester)". During the folding test, the fibers do not break, but fiber-fiber bonds are loosened gradually, which leads to a decrease in tensile strength and final fracture of paper. The test was performed using Tinius Olsen MIT Folding Endurance Tester. The apparatus consists of a stationary clamping jaws, a spring for applying the desired load and an oscillating clamping jaw to induce folding of the sample. A specimen was clamped in the tester, and the spring was set to give 1.5 kilograms of load. The oscillating jaw folded the specimen in the rate of 175±5 cycles/min. An automatic counter recorded the number of double fold cycles to sample breakage. 10 specimens were tested for averaging.

EXAMPLES

Control

In a control experiment, a paper sample was subjected to the same treating process except that tap water instead of treating solution was used to treat the paper. The paper sheet was immersed in tap water, pressed between two squeezing rolls, dried in a hot plate dryer at 85° C. for about 3 min, and then heated in the oven at 130° C. for 1.5 min. The properties of the control sample are listed in Table 1.

TABLE 1

Properties of control sample of kraft paper

| W/D Ratio * | Dry strength | Stretch | Folding Endurance |
|---|---|---|---|
| 9.8% | 4.1 kN/m | 7.6% | 489 times |

* Ratio of wet strength/dry strength.

Example 1

Effect of Curing Temperature Using Catalyst 531

One testing solution contained 2.0% glutaraldehyde, 1.0% PVA, and 1.8% Catalyst 531. Another testing solution was the same, without the addition of PVA. Separate paper samples were cured at 110, 120, 130 and 140° C. for 1.5 min. The properties of the treaded paper are listed in Table 2.

Table 2 shows that the paper treaded with gluteraldehyde and PVA exhibits an increasing W/D ratio from 30% at 110° C. to 49% at 140° C.

One observes a significant improvement in dry strength and folding endurance over the control sample.

TABLE 2

Properties of kraft paper treated with 2.0% Glutaraldehyde, with and without 1% PVA, and 1.8% Catalyst 531, cured at 110–140° C. for 1.5 min

| Treatment | Temperature (° C.) | W/D Ratio (%) * | Increase in dry strength (%) ** | Folding Endurance (times) |
|---|---|---|---|---|
| No PVA | 110 | 21 | 0 | not measured |
| | 120 | 25 | 2 | not measured |
| | 130 | 38 | 2 | not measured |
| | 140 | 41 | 5 | not measured |
| PVA | 110 | 30 | 19 | 668 |
| | 120 | 36 | 16 | 745 |
| | 130 | 41 | 16 | 704 |
| | 140 | 49 | 19 | 581 |

* W/D ratio is wet strength of treated paper over dry strength of control sample
** As compared to control sample

Example 2

Effect of Gluteraldehyde Concentration

A series of solutions contained 1.0% PVA, different amounts of glutaraldehyde and Catalyst 531. The amount of glutaraldehyde ranged from 1.0% to 8.0%, and the ratio of glutaraldehyde/Catalyst 531 was kept at 1:0.9. All samples were cured at 130° C. for 1.5 min. The properties of treated paper are listed in Table 3.

Table 3 shows that the treated paper exhibits an increasing W/D ratio up to 79% as the amount of glutaraldehyde increases to 5.0%.

One also observes a significant increase in dry strength and folding endurance over the control sample as the amount of gluteraldehyde increases to 3%.

TABLE 3

Properties of kraft paper treated by 1.0% PVA and in combination with different concentrations of glutaraldehyde cured at 130° C. for 1.5 min.

| Glutaraldehyde (%) | W/D Ratio (%) | Change in Dry Strength (%) | Folding Endurance (times) |
|---|---|---|---|
| 1 | 23 | 14 | 691 |
| 2 | 40 | 22 | 633 |
| 3 | 65 | 19 | 657 |
| 5 | 79 | −2 | 78 |
| 8 | 69 | −20 | 4 |

Example 3

Effect of Changing PVA Concentrations

A series of solutions contained of 2.0% glutaraldehyde, 1.8% Catalyst 531, and different amounts of PVA (0, 0.25, 0.5, 1.0, 2.0, and 3.0%). All samples were cured at 130° C. for 1.5 min. The properties of treated paper are listed in Table 4.

Table 4 shows that all of the treated paper have a W/D around 40%. However, the dry strength and folding endurance increase significantly with increasing concentration of PVA.

TABLE 4

Properties of kraft paper treated by 2.0% glutaraldehyde, 1.8% Catalyst 531, and different amounts of PVA, cured at 130° C. for 1.5 min

| PVA (%) | Increase in dry strength (%) | W/D ratio (%) | Folding Endurance (times) |
|---|---|---|---|
| 0.0 | 2 | 38 | 305 |
| 0.25 | 7 | 41 | 439 |
| 0.5 | 13 | 42 | 522 |
| 1.0 | 22 | 40 | 633 |
| 2.0 | 30 | 39 | 651 |
| 3.0 | 30 | 40 | 748 |

Example 4

Effect of Curing Temperature Using $AlCl_3$ as Catalyst

A solution contained 1.173% PVA, 2.0% glutaraldehyde, and 0.534% $AlCl_3$ as a catalyst. The solution has a pH of 4.3. The samples were cured at 110, 120, 130, and 140° C. for 1.5 min. The properties of treated paper are listed in Table 5.

Table 5 shows that the treated paper exhibits a significant improvement of wet strength, with a W/D ratio of 29% when cured at 110° C., and 49% at 140° C. Dry strength is improved from 19% to 12% over the control sample, while folding endurance is improved (about 100 to 300 folds more than a control sample). A higher curing temperature brings about more improvement in wet strength, but less increase in folding endurance.

TABLE 5

Properties of kraft paper treated with 2.0% Glutaraldehyde, 1.173% PVA, and 0.534% $AlCl_3$, pH 4.3, cured at 110–140° C. for 1.5 min

| Temperature (° C.) | W/D Ratio (%) | Increase in Dry Strength (%) | Folding Endurance (times) |
|---|---|---|---|
| 110 | 29 | 19 | 795 |
| 120 | 34 | 19 | 680 |
| 130 | 40 | 15 | 606 |
| 140 | 49 | 12 | 578 |

Example 5

Effect of Curing Temperature Using Zn $(NO_3)_2$ Catalyst

A solution contained 1.173% PVA, 2.0% glutaraldehyde, and 0.758% $Zn(NO_3)_2$ as a catalyst. The solution had a pH of 4.3. The samples were cured at 100, 110, 120, 130, 140, and 150° C. for 1.5 min. The properties of treated paper are listed in Table 6.

Table 6 shows that the treated paper exhibits a significant improvement of wet strength, with a W/D ratio of 27% when cured at 100° C., and 70% at 150° C. as compared to 25% with no curing. The dry strength improvement over the control sample varies from 13% to 23%, while folding endurance is also significantly improved except when the wet strength is very high.

TABLE 6

Properties of kraft paper treated with 2.0% Glutaraldehyde, 1.173% PVA, and 0.758% $Zn(NO_3)_2$, pH 4.3, cured at different temperatures for 1.5 min.

| Temperature (° C.) | W/D Ratio (%) | Increase in Dry Strength (%) | Folding Endurance (times) |
|---|---|---|---|
| No Curing | 25 | 22 | 462 |
| 100 | 27 | 20 | 571 |
| 110 | 35 | 23 | 701 |
| 120 | 40 | 22 | 723 |
| 130 | 53 | 22 | 565 |
| 140 | 62 | 17 | 387 |
| 150 | 70 | 13 | 161 |

Example 6

Effect of pH Using Zn $(NO_3)_2$ Catalyst

A series of solutions contained 1.173% PVA, 2.0% glutaraldehyde, and 0.758% $Zn(NO_3)_2$ as a catalyst, with different pH (3.8, 4.3, 4.8, 5.4). All samples were cured at 130° C. for 1.5 min. The properties of treated paper are listed in Table 7.

Table 7 shows that all treated samples exhibit a significant improvement of wet strength over the control sample, with a W/D ratio from 42% to 58%. The dry strength and folding endurance are also improved significantly at different pH over the control sample. The results indicate that the crosslinking system is able to significantly improve the wet strength, dry strength and folding endurance.

TABLE 7

Properties of kraft paper treated with 2.0% Glutaraldehyde, 1.173% PVA, and 0.758% $Zn(NO_3)_2$, different pH, cured at 130° C. for 1.5 min

| pH | W/D Ratio (%) | Change in dry strength (%) | Folding Endurance (times) |
|---|---|---|---|
| 3.8 | 58 | 15 | 558 |
| 4.3 | 53 | 18 | 642 |
| 4.8 | 42 | 15 | 492 |
| 5.4 | 47 | 17 | 501 |

Example 7

Effect of Changing Concentration of PVA, Gluteraldehyde and $Zn(NO_3)_2$ Catalyst Three solutions with different concentrations of PVA, gluteraldehyde and Zn $(NO_3)_2$ as catalyst were prepared. All solutions had a pH of 3.8. All samples were cured at 130° C. for 1.5 min. The composition of solutions and the properties of treated paper are listed in Table 8.

Table 8 shows that all treated samples exhibit a significant improvement in wet strength, dry strength and folding endurance over the control sample. It also indicates the wet strength of treated paper increases progressively as the concentration of the components in the solution increases.

TABLE 8

Properties of kraft paper treated with different amounts of wet-strength agent, pH 3.8, cured at 130° C. for 1.5 min

| Treating solution | | | | | |
|---|---|---|---|---|---|
| PVA (%) | Glutaraldehyde (%) | $Zn(NO_3)_2$ | W/D ratio (%) | Change in dry Strength (%) | Folding Endurance (times) |
| 0.391 | 0.333 | 0.252 | 23 | 15 | 668 |
| 0.782 | 0.667 | 0.505 | 42 | 12 | 532 |
| 1.173 | 2.0 | 0.758 | 53 | 18 | 642 |

Example 8

Effect of pH Using $NH_4Cl$ Catalyst

A series of solutions contained the same concentrations of chemicals (1.173% PVA, 2.0% glutaraldehyde, and 0.53% $NH_4Cl$ as catalyst), at different pH (3.5, 4.3, 5.0, 5.5, and 6.2). All samples were cured at 130° C. for 1.5 min. The properties of treated paper are listed in Table 9.

Table 9 shows that all treated samples exhibit a significant improvement of wet strength over the control sample, with a W/D around 30% for all samples. The dry strength and folding endurance are also improved significantly over the control sample for all the pH conditions. The results indicate that the crosslinking system is able to significantly improve the wet strength, dry strength and folding endurance.

TABLE 9

Properties of kraft paper treated with 1.173% PVA, 2.0% Glutaraldehyde, and 0.53% $NH_4Cl$, with different pH, and cured at 130° C. for 1.5 min

| pH | W/D Ratio (%) | Increase in dry strength (%) | Folding Endurance (times) |
|---|---|---|---|
| 3.5 | 32 | 15 | 576 |
| 4.3 | 30 | 18 | 562 |
| 5.0 | 28 | 13 | 561 |
| 5.5 | 30 | 20 | 490 |
| 6.2 | 27 | 23 | 559 |

Example 9

Effect of No Catalyst

This example is used to show the effects of the catalyst. A solution contained 1.173% PVA and 2.0% glutaraldehyde (No catalyst is used) with a pH of 4.3. The samples were cured at 110, 120, 130, and 140° C. for 1.5 min. The properties of treated paper are listed in Table 10.

Table 10 shows that the paper treated with the solution without catalyst exhibit much less improvement of wet strength than papers prepared using catalyst in the treatment solutions, with a W/D ratio less than 20%. The dry strength and folding endurance are improved over the control sample even though no catalyst is used. The results indicate that the use of catalyst is important for the improvement of wet strength of treated paper.

TABLE 10

Properties of kraft paper treated with 2.0% Glutaraldehyde and 1.173% PVA with pH 4.3 (No catalyst), cured at 110–140° C. for 1.5 min

| Temperature (° C.) | W/D Ratio (%) | Increase in Dry Strength (%) | Folding Endurance (times) |
|---|---|---|---|
| 110 | 17 | 17 | 498 |
| 120 | 17 | 17 | 600 |
| 130 | 19 | 15 | 633 |
| 140 | 20 | 10 | 533 |

Example 10

Effect of Using Glyoxal

The experiment was performed to compare the effectiveness between glyoxal and glutaraldehyde. Two solutions contained same concentrations of chemicals (1.173% PVA and 1.16% (0.02 mol) glyoxal) with pH 4.3. However, one solution did not contain catalyst, while another solution contained 0.758% $Zn(NO_3)_2$ as a catalyst. The samples were cured at 110, 120, 130, 140, and 150° C. for 1.5 min. The properties of treated paper are listed in Table 11.

We found that the samples treated with glyoxal solution without catalyst show little improvement in wet strength over the control sample, even though a significant improvement of dry strength, and limited improvement of folding endurance are achieved. When $Zn(NO_3)_2$ was added as a catalyst, an improvement of wet strength with a W/D ratio up to 33% can be achieved, but the folding endurance is reduced as compared with control sample. The results indicate that glutaraldehyde is more effective than glyoxal for the crosslinking system to improve wet strength and folding endurance of treated paper.

TABLE 11

Properties of paper treated with 1.173% PVA and 1.16% Glyoxal(0.02 mol) with and without 0.758% $Zn(NO_3)_2$ as catalyst, and cured at different temperatures for 1.5 min.

| Temperature (° C.) | W/D Ratio (%) | Change in Dry Strength (%) | Folding Endurance (times) |
|---|---|---|---|
| No catalyst | | | |
| No Curing | 8 | 17 | 468 |
| 110 | 12 | 23 | 528 |
| 120 | 12 | 23 | 518 |
| 130 | 12 | 20 | 510 |
| 140 | 13 | 22 | 441 |
| 150 | 17 | 17 | 583 |
| 0.758% $Zn(NO_3)_2$ | | | |
| No Curing | 15 | 20 | 292 |
| 110 | 20 | 22 | 446 |
| 120 | 22 | 17 | 369 |
| 130 | 23 | 18 | 375 |
| 140 | 30 | 12 | 279 |
| 150 | 33 | 8 | 171 |

Example 11

Effect of $MgCl_2$ as With Glyoxal and Gluteraldehyde Catalyst

A series of experiments was performed comparing 1.16% glyoxal (0.02 mol)/1.173% PVA treatment with 2% gluteraldehyde (0.02 mol)/1.173% PVA treatment using either no catalyst, or 0.38% $MgCl_2$ at pH 3.3 or 4.3. The samples were cured at 130° C. for 1.5 minutes. The W/D ratio, increase in dry strength and folding endurance is shown in Table 15.

Table 12 shows that the characteristics of the paper are improved for gluteraldehyde treatment as compared to glyoxal treatment.

TABLE 12

Comparison of wet strength (W/D ratio), dry strength and folding endurance of Kraft paper treated with PVA/glyoxal and PVA/gluteraldehyde with and without $MgCl_2$ catalyst

| | Dialdehyde % | PVA % | Catalyst % | pH | % Increase Dry Strength | % W/D Strength Ratio | Folding Endurance (Times) |
|---|---|---|---|---|---|---|---|
| Glyoxal | 1.16 (0.2 M) | 1.173 | No | 3.3 | 11.3% | 19.4% | 372 |
| | " | " | " | 4.3 | 14.5% | 19.4% | 427 |
| | " | " | $MgCl_2$ 0.38% | 3.3 | 12.9% | 22.6% | |
| | " | " | " | 4.3 | 8.1% | 19.4% | |

TABLE 12-continued

Comparison of wet strength (W/D ratio), dry strength and folding endurance of Kraft paper treated with PVA/glyoxal and PVA/gluteraldehyde with and without $MgCl_2$ catalyst

| Dialdehyde % | | PVA % | Catalyst % | pH | % Increase Dry Strength | % W/D Strength Ratio | Folding Endurance (Times) |
|---|---|---|---|---|---|---|---|
| Glutaraldehyde | 2.0 (0.2 M) | " | No | 3.3 | 25.8% | 24.2% | |
| | " | " | No | 4.3 | 17.7% | 17.7% | |
| | " | " | $MgCl_2$ 0.38% | 3.3 | 20.0% | 40.0% | 640 |
| Control | | | | | | 11.3% | 520 |

Example 12

Permanence of Wet Strength With PVA/Gluteraldehyde/Catalyst

The experiment was performed to study the permanence of wet strength imparted by the wet-strengthening system, i.e., PVA/Glutaraldehyde/Catalyst. The samples were treated with 1.173% PVA and 2.0% glutaraldehyde (0.2M) with and without using a catalyst at different pH and curing temperatures. The wet strength of treated paper was measured after the specimens were soaked in water for 10 min, 0.5 hour, 24 hours, and 240 hours. The W/D ratios of treated paper are listed in Table 13.

Table 13 shows that the wet strength of paper treated by combination of PVA and glutaraldehyde decreases very slowly with prolonged soaking in water.

TABLE 13

W/D ratio of paper treated with 1.173% PVA and 2.0% Glutaraldehyde with and without a catalyst

| Treatment | Temperature (° C.) | Soaking Time 10 min. | 0.5 hour | 24 hours | 240 hours |
|---|---|---|---|---|---|
| No catalyst, pH 4.3 | 110 | 24 | 20 | 17 | |
| " | 120 | 25 | 22 | 17 | |
| " | 130 | 25 | 22 | 19 | |
| " | 140 | 25 | 24 | 20 | |
| 0.758% $Zn(NO_3)_2$, pH 4.3 | No Curing | 30 | 27 | 25 | |
| " | 100 | 32 | 32 | 27 | |
| " | 110 | 40 | 40 | 35 | |
| " | 120 | 47 | 47 | 40 | |
| " | 130 | 57 | 55 | 53 | 52 |
| " | 140 | 65 | 65 | 62 | |
| " | 150 | 72 | 68 | 70 | |
| 0.758% $Zn(NO_3)_2$, pH 3.8 | 130 | 65 | 62 | 58 | 55 |
| 0.758% $Zn(NO_3)_2$, pH 4.8 | 130 | 44 | 43 | 42 | 38 |
| 0.534% $AlCl_3$, pH 4.3 | 130 | 40 | 40 | 40 | 36 |
| 0.534% $AlCl_3$, pH 4.3 | 140 | 49 | 49 | 49 | 44 |

Example 13

Permanence of Wet Strength With PVA/Glyoxal

The experiment was performed to study the permanence of wet strength imparted by combination of PVA and glyoxal with and without catalyst. The samples were treated with 1.173% PVA and 1.16% (0.2M) glyoxal with and without 0.758% $Zn(NO_3)_2$ as a catalyst at pH 4.3. The wet strength of treated paper was measured after the specimens were soaked in water for 10 min., 0.5 hour, and24hours. The W/D ratios of treated paper are listed in Table 14.

Table 14 shows that the wet strength of paper treated by combination of PVA and glyoxal decreases very quickly when the treated paper is soaked in water. When no catalyst is used, the W/D ratio decrease from about 40% after 10 min soaking to about 10% after 24 hours of soaking. When $Zn(NO_3)_2$ is used as catalyst, the permanence of wet strength is improved, but still inferior to that provided by the combination of PVA and glutaraldehyde. The results also indicate that glutaraldehyde not only shows significantly higher effectiveness in improving wet strength and folding endurance of paper, but also provides much better durability of wet strength to treated paper.

TABLE 14

W/D ratio of paper treated with 1.173% PVA and 1.16% Glyoxal with and without adding a catalyst,

| Treatment | Temperature (° C.) | Soaking Time 10 min. | 0.5 hour | 24 hours |
|---|---|---|---|---|
| No Catalyst, pH 4.3 | No Curing | 52 | 42 | 8 |
| " | 110 | 43 | 30 | 12 |
| " | 120 | 47 | 33 | 12 |
| " | 130 | 40 | 28 | 12 |
| " | 140 | 45 | 33 | 13 |
| " | 150 | 42 | 32 | 17 |
| $Zn(NO_3)_2$, pH 4.3 | No Curing | 48 | 33 | 15 |
| " | 110 | 37 | 28 | 20 |
| " | 120 | 42 | 32 | 22 |
| " | 130 | 37 | 32 | 23 |
| " | 140 | 45 | 38 | 30 |
| " | 150 | 43 | 42 | 33 |

Example 14

Effect of Curing Temperature and Catalyst Using Gluteraldehyde or Glyoxal

The experiment was performed to compare the effectiveness of glutaraldehyde and glyoxal in improving wet strength of treated paper. The samples were treated either with 1.173% PVA and 2% gluteraldehyde (0.2M) or 1.173% PVA and 1.16% glyoxal (0.2M), with and without 0.758% $Zn(NO_3)_2$ as a catalyst at pH 4.3. The samples were cured at different temperatures for 1.5 minutes. The W/D ratios are listed in Table 15.

TABLE 15

Comparison of wet strength (W/D ratio) of kraft paper treated by 1.173% PVA/2.0% glutaraldehyde (0.2M) with and without 0.758% $Zn(NO_3)_2$ as a catalyst, 1.173% PVA/1.16% glyoxal (0.2M) with and without 0.758% $Zn(NO_3)_2$ as a catalyst, cured at different temperatures for 1.5 min

| Treatment | Temperature(° C.) | W/D ratio |
|---|---|---|
| PVA/Glutaraldehyde, pH 4.3 | 110 | 17 |
| | 120 | 17 |
| | 130 | 19 |
| | 140 | 20 |

TABLE 15-continued

Comparison of wet strength (W/D ratio) of kraft paper treated by 1.173% PVA/2.0% glutaraldehyde (0.2M) with and without 0.758% $Zn(NO_3)_2$ as a catalyst, 1.173% PVA/1.16% glyoxal (0.2M) with and without 0.758% $Zn(NO_3)_2$ as a catalyst, cured at different temperatures for 1.5 min

| Treatment | Temperature(° C.) | W/D ratio |
|---|---|---|
| PVA/Glutaraldehyde/$Zn(NO_3)_2$, pH 4.3 | 110 | 35 |
| | 120 | 40 |
| | 130 | 53 |
| | 140 | 62 |
| | 150 | 70 |
| PVA/Glyoxal, pH 4.3 | 110 | 12 |
| | 120 | 12 |
| | 130 | 12 |
| | 140 | 13 |
| | 150 | 17 |
| PVA/Glyoxal $Zn(NO_3)_2$ pH 4.3 | 110 | 20 |
| | 120 | 22 |
| | 130 | 23 |
| | 140 | 30 |
| | 150 | 33 |

Although the description above contains many specificities, these should not be constructed as limiting the scope of the invention but as merely providing examples of some of the presently-preferred embodiments of this invention. Thus, the scope of the invention should be determined by the appended claims and their legal equivalents, rather than by the examples given. Scheme 1 Pentanedialated-PVA (possible structure)

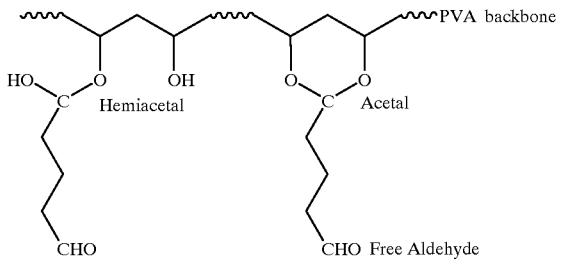

We claim:

1. A method of treating paper comprising: contacting said paper with a hydroxy-containing polymer and a multifunctional aldehyde, in the presence of a catalyst wherein the multifunctional aldehyde has formula:

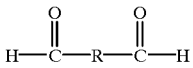

where R is a divalent aliphatic, cycloaliphatic, aromatic or heterocyclic group having from 1 to 12 carbon atoms;

the multifunctional aldehyde is present at a concentration of about 50% to about 800% weight percent of the polymer present;

and the total weight of hydroxy-containing polymer and multifunctional aldehyde is about 0.1% to about 10% based on the dry weight of pulp fibers, provided that the hydroxy-containing polymer is not amine-functionalized and provided that the hydroxy-containing polymer has a viscosity of greater than 20 cps.

2. The method of claim 1, further comprising a catalyst selected from the group consisting of: $AlCl_3$, $Al_2(SO_4)_3$, $Al(NO_3)_3$, alum, $ZnCl_2$, $Zn(NO_3)_2$, $Zn(CH_3COO)_2$, $MgCl_2$, $Mg(NO_3)_2$, $Mg(CH_3COO)_2$, $NH_4Cl$ and amino acids; wherein said catalyst is present at a weight ratio between about 1:0.1 to about 1:2 multifunctional aldehyde:catalyst;

and the total weight of hydroxy-containing polymer, multifunctional aldehyde and catalyst is about 0.1% to about 10% based on the dry weight of pulp fibers, provided that the hydroxy-containing polymer is not amine-functionalized.

3. The method of claim 2, wherein said multifunctional aldehyde is gluteraldehyde.

4. The method of claim 2, wherein said hydroxy-containing polymer is poly vinyl alcohol.

5. The method of claim 2, wherein the multifunctional aldehyde:polymer weight ratio is greater than 1:1.

6. The method of claim 2, wherein the total weight of hydroxy-containing polymer, multifunctional aldehyde and catalyst is between about 0.25% to about 4% by weight of the dry weight of paper treated.

7. The method of claim 2, further comprising curing the paper at a sufficient conditions to cause the desired improvement in strength properties of said paper.

8. The method of claim 7, wherein said sufficient conditions are a temperature which is between about 100 to about 150° C. for a time which is between about 0.5 and about 5 minutes.

9. The method of claim 2, wherein said catalyst is present at a weight ratio from about 1:0.2 to about 1:1 multifunctional aldehyde:catalyst.

10. Paper treated with the method of claim 7.

11. A paper treatment composition comprising: a hydroxy-containing polymer and a multifunctional aldehyde and a catalyst wherein:

the multifunctional aldehyde has formula:

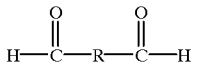

where R is a divalent aliphatic, cycloaliphatic, aromatic or heterocyclic group having from 1 to 12 carbon atoms;

the multifunctional aldehyde is present at a concentration of about 50% to about 800% weight percent of the polymer present;

and the total weight of hydroxy-containing polymer and multifunctional aldehyde is about 0.1% to about 10% based on the dry weight of pulp fibers, provided that the polymer is not amine-functionalized and provided that the hydroxy-containing polymer has a viscosity of greater than 20 cps.

12. The composition of claim 11 wherein the multifunctional aldehyde is gluteraldehyde and said hydroxy-containing polymer is PVA.

13. The composition of claim 11, further comprising a catalyst selected from the group consisting of: $AlCl_3$, $Al_2(SO_4)_3$, $Al(NO_3)_3$, alum, $ZnCl_2$, $Zn(NO_3)_2$, $Zn(CH_3COO)_2$, $MgCl_2$, $Mg(NO_3)_2$, $Mg(CH_3COO)_2$, $NH_4Cl$ and amino acids, wherein the catalyst is present at a weight ratio between about 1:0.1 to about 1:2 multifunctional aldehyde:catalyst;

and the total weight of hydroxy-containing polymer, multifunctional aldehyde and catalyst is about 0.1% to about 10% based on the dry weight of pulp fibers, provided that the polymer is not amine-functionalized.

14. A method of using the composition of claim 13 in a paper making process comprising: contacting said paper with the composition of claim 13 for a time sufficient to deposit the desired amount of composition on said paper; curing said paper at a sufficient conditions to cause the desired improvement in strength properties of said paper.

15. The method of claim 14, wherein said sufficient conditions to cause the desired improvement in strength properties of said paper is a time and temperature which is between about 100° C. to about 200° C. and a time which is between about 0.5 to about 5 minutes.

16. The method of claim 14, wherein said multifunctional aldehyde is gluteraldehyde and said hydroxy-containing polymer is PVA.

17. In a papermaking process, the improvement for producing paper having improved strength properties, said improvement comprising: adding a hydroxy-containing polymer, a multifunctional aldehyde and a catalyst to paper wherein:

the catalyst is selected from the group consisting of: $AlCl_3$, $Al_2(SO_4)_3$, $Al(NO_3)_3$, alum, $ZnCl_2$, $Zn(NO_3)_2$, $Zn(CH_3COO)_2$, $MgCl_2$, $Mg(NO_3)_2$, $Mg(CH_3COO)_2$, $NH_4Cl$ and amino acids;

the multifunctional aldehyde has formula:

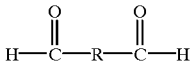

where R is a divalent aliphatic, cycloaliphatic, aromatic or heterocyclic group having from 1 to 12 carbon atoms;

the multifunctional aldehyde is present at a concentration of about 50% to about 800% weight percent of the polymer present;

the catalyst is present at a weight ratio between about 1:0.1 to about 1:2 multifunctional aldehyde:catalyst;

and the total weight of hydroxy-containing polymer, multifunctional aldehyde and catalyst is about 0.1% to about 10% based on the dry weight of pulp fibers, provided that the polymer is not amine-functionalized.

18. The process of claim 17 wherein the multifunctional aldehyde is gluteraldehyde.

19. The process of claim 17, further comprising curing the paper for a sufficient time and temperature to cause the desired improvement in properties to occur.

20. The process of claim 19, wherein said sufficient time and temperature is a temperature which is between about 100° C. to about 200° C. and a time which is between about 0.5 to about 5 minutes.

* * * * *